United States Patent [19]

Murphy

[11] 4,280,353

[45] Jul. 28, 1981

[54] MACHINE WITH PNEUMATIC STRIPPING

[75] Inventor: Kelly J. Murphy, Boulder, Colo.

[73] Assignee: Ball Corporation, Muncie, Ind.

[21] Appl. No.: 51,574

[22] Filed: Jun. 25, 1979

[51] Int. Cl.[3] ..... B21D 45/00

[52] U.S. Cl. ..... 72/345; 72/344; 72/427

[58] Field of Search ..... 72/345, 344, 427, 349

[56] References Cited

U.S. PATENT DOCUMENTS

| | | | |
|---|---|---|---|
| 2,579,940 | 12/1951 | Lobrovich | 72/345 |
| 3,524,338 | 8/1970 | Bozek | 72/345 |
| 3,605,499 | 9/1971 | Puetetti | 72/345 |
| 3,635,069 | 1/1972 | Eickenhorst | 72/345 |
| 3,771,344 | 11/1973 | Wright | 72/345 |

*Primary Examiner*—Leon Gilden

*Attorney, Agent, or Firm*—Gilbert E. Alberding

[57] ABSTRACT

The present invention is related to pneumatic stripping for use with metal forming machines, including neckers, that are used in the production of thin shell vessels such as beverage cans (60). In prior art devices, pneumatic stripping has been advantageously used for removing a beverage can (60) from the punch portion (18) of a die set (16); but this use of compressed air has been accompanied by objectionably high noise levels. The present invention provides an expansion chamber (50), that is formed by a recess (48) in an end (30) of the punch (18) and that reduces the noise level of pneumatic stripping. Principle uses include noise reduction on machines that are used to inwardly dome the bottom of beverage cans and on machines that are used to neck down the open ends of beverage cans.

8 Claims, 6 Drawing Figures

MACHINE WITH PNEUMATIC STRIPPING

TECHNICAL FIELD

The present invention relates to metal forming machines having pneumatic parts strippers, and more particularly to neckers of the type being used for reducing the open end of a drawn shell beverage container and having pneumatic container strippers.

BACKGROUND ART

Drawn shell beverage containers, whether fabricated from aluminum or steel, customarily are reduced in diameter proximal to the open end of the container prior to rolling the lid or top onto the container. This reduction in diameter near the top or open end of the container is done primarily to achieve a material saving and consequent cost saving in the lid or top. However, this reduction in diameter near the open end is also effective to reduce the outside diameter of the lid bead to a diameter that is equal to or less than the unnecked portion of the container; and so this reduction in bead diameter facilitates both automatic handling in production and automatic vending.

Machines for performing the necking operation are customarily of the type having a dozen or so working stations and a like number of die sets that are longitudinally disposed with respect to the rotating axis of the drum, and that are circumferentially spaced around the periphery of the drum. Each container is hopper fed to a loading station on the drum, is received into one of the die sets, receives the necking operation while rotating with the drum, and is discharged from the drum prior to the drum completing one revolution of the drum.

Injection of a container into a given working station, forcing of the container into the necking die, coordinated movement of the knockout punch, and forcing of the container out of the necking die by the knockout punch are all controlled by stationary cams that are located at opposite ends of the drum. A machine of this general type is shown and described by Eickenhorst in U.S. Pat. No. 3,635,069.

Forcing of the container out of engagement with the necking die is customarily a mechanical function that is achieved by a shoulder on the knockout punch; and compressed air is customarily used to strip the container off of the knockout punch.

Wright, in U.S. Pat. No. 3,771,344, shows and describes a pneumatic stripping device in which a poppet valve, that is located in the bottom of the punch portion of the die set and that includes an opening stem, is opened by the bottom of the container as the bottom of the container is domed inwardly and actuates the stem inwardly, and is closed by air pressure as the container is pneumatically stripped from the punch and the stem is no longer actuated inwardly with respect to the punch.

Eickenhorst, in the aforementioned patent, shows and describes the use of compressed air to eject a container from a punch portion of a die set after completion of a forming operation wherein the bottom of a container is domed inwardly. The compressed air is valved to each successive working station by a commutating valve that includes an arcuately disposed and angularly positioned slot in the base of a fixed disk.

The valving of the air, in a machine such as taught by Eickenhorst, must be timed so that air is provided within the container not only for stripping the container from the knockout punch but also both for propelling the container backward against a stop plate and for stabilizing the container against the back plate. Thus, the air cannot be shut off early to allow the air pressure in the container to be reduced before the container leaves the punch and the compressed air is exhausted to the atmosphere; and so there is an air blast noise problem which is associated with air stripping which cannot be solved by adjusting the timing of the valving of the air in Eickenhorst's machine. In contrast, the poppet valve arrangement of Wright may provide somewhat of a lower noise level than that of Eickenhorst, although neither inventor mentions noise levels, but Wright's device inherently shuts off the air too soon to adequately stabilize the container against the back plate subsequent to stripping.

The present invention is not concerned with timing of the compressed air as is the above prior art; but, instead provides an expansion chamber in the punch for reduction of air blast noise that is associated with the pneumatic stripping operation.

While compressed air stripping is quite advantageous, as opposed to mechanical stripping, for stripping of delicate thin shell vessels, such as beverage containers, from mandrels and punches, and is extensively used, the noise levels that are associated with air stripping are excessively high and usually exceed present day government noise regulations. Thus, the present invention provides a needed advancement to the prior art, not only to improve operator comfort and to reduce operator fatigue, but also to meet governmental noise regulations.

DISCLOSURE OF INVENTION

In accordance with the broader aspects of the present invention, there is provided a pneumatic stripping device for a metal forming machine. The machine includes a mandrel having a shaft portion and a head portion. The shaft portion includes an elongated longitudinal axis and a first end that is substantially orthogonal to the longitudinal axis; and the head portion is secured to the shaft portion with a second end of the head portion juxtaposed against the first end and a third end of the head portion distal from the juxtaposed ends.

The pneumatic stripping device is provided in the mandrel by including a recess in one of the juxtaposed ends. A first passageway that is disposed in the shaft portion furnishes compressed air to the expansion chamber; and a second passageway, comprising a hole that extends from the expansion chamber through the third end, delivers the compressed air from the expansion chamber through the first end.

If the machine is used to form inwardly domed bottoms in beverage cans, then the head portion of the mandrel is the punch that is inserted into the can; and if the machine is a necker that is used to reduce the diameter of the can proximal to the open end, then the mandrel portion is the knockout punch. In either case, subsequent to the forming operation, compressed air is supplied to the inside of the can from the second passageway; and the compressed air strips the can from the punch.

The area of the second passageway is larger than the area of the first passageway so that the compressed air is supplied to the inside of the can at lower velocity than the air that is received by the expansion chamber. Also, the expansion chamber serves to absorb a portion of the change in air velocity that customarily accompanies the blasting off of the container or can from the punch.

The advantages of the present invention include noise reductions of twenty decibels or so, as opposed to prior art designs. The present invention is not only effective in reducing noise, but it is also simple, economical, trouble free, and durable. Further, it can be incorporated into the tooling without any changes to the basic machine.

The abovementioned and other advantages of the present invention and the manner of attaining them will become more apparent and the invention will be best understood by reference to the following description of an embodiment of the invention taken in conjunction with the accompanying drawings.

Best Mode for Carrying Out the Invention

Figure 1:
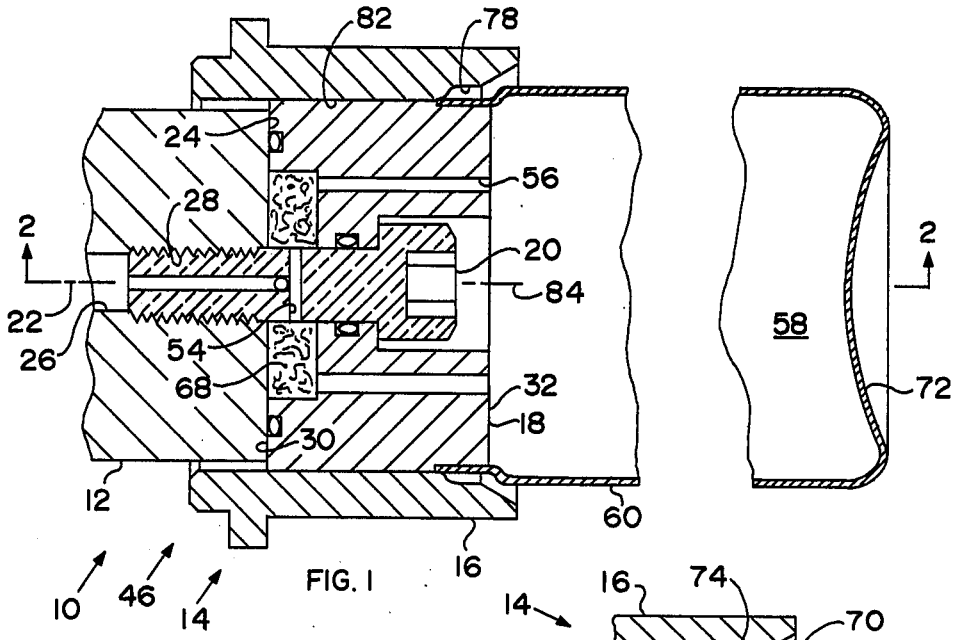
FIG. 1 is a longitudinal cross-section of a ram of a necking machine, a necking die set, and a container, showing the knockout punch positioned for pneumatic stripping.
Figure 2:
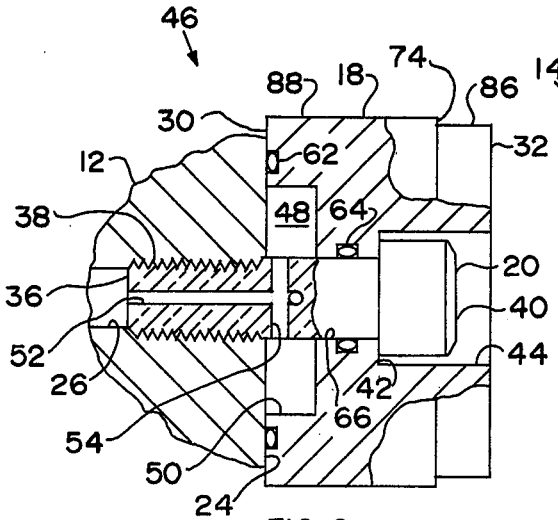
FIG. 2 is a partial cross-section of the ram, of the knockout punch of the necking die set, and of the container of FIG. 1, taken substantially as shown by section line 2—2.

Referring now to the drawings, and more particularly to FIGS. 1 and 2, a machine or necking machine 10 includes a ram 12 for use with a necking die set 14. The necking die set 14 includes a necking die 16 that is attached to the machine or necking machine 10 by means which is not shown and which does not comprise a portion of the present invention, and a knockout punch 18 that is attached to the ram 12 by a threaded fastener 20.

The ram 12 includes an elongated longitudinal axis 22 and provides reciprocating motion along the longitudinal axis 22 for actuation of the knockout punch 18. The ram 12 further includes an end 24 that is substantially orthogonal to the longitudinal axis 22 and a longitudinally disposed hole 26 that communicates with the end 24 and that is disposed substantially concentric with the longitudinal axis 22. The hole 26 includes internal threads 28 that are disposed proximal to and opening through the end 24.

The knockout punch 18 includes an end 30 that is juxtaposed against the end 24, and an end 32 that is distal from the juxtaposed ends 24 and 30. The threaded fastener 20 includes an end 36, an externally threaded portion 38 that is proximal to the end 36, and a head 40; and the knockout punch 18 is firmly secured to the ram 12 by pressure that the head 40 exerts on a shoulder 42 of a counter bore 44 in the knockout punch 18; and by engagement of the externally threaded portion 38 with the internal threads 28.

The ram 12 and the knockout punch 18 serve as a mandrel means 46, and the mandrel means 46 is provided with an expansion chamber 48. The expansion chamber 48 comprises a recess 50 which extends longitudinally inward from the end 30 and also comprises the end 24 of the ram 12.

The threaded fastener 20 includes a longitudinally disposed hole 52 and four transversely disposed holes 54, comprising two cross holes that are longitudinally staggered, that communicate with the longitudinally disposed hole 52. The longitudinally disposed hole 26, the longitudinally disposed hole 52, and the transversely disposed holes 54 together comprise first passageway means having a minimum flow path area that is customarily determined by the diameter of the longitudinally disposed hole 52.

The knockout punch 18 includes a plurality of longitudinally disposed holes 56 that intercept the end 32, that communicate with the expansion chamber 48, that cooperate with each other to provide second passageway means having a total minimum flow path area, and that serve to supply compressed air from the expansion chamber 48 to an interior or bottomed recess 58 of a container or beverage can 60.

Preferably, the mandrel means 46 includes an O-ring seal 62 that provides a pneumatic seal between the ends 24 and 30 and an O-ring seal 64 that provides a pneumatic seal between the threaded fastener 20 and a hole 66 through which the threaded fastener 20 passes. Optionally, the expansion chamber 48 is filled with a porous diffusing material 68 such as stainless steel wool.

Figure 3:
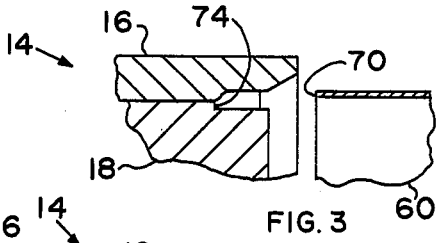
FIG. 3 is a partial cross-sectional view of the necking die set and container of FIG. 1, taken substantially as shown in FIG. 1, and showing the knockout punch positioned for receiving the open end of the container.

Referring now to FIGS. 1–6, when a plurality of the necking die sets 14 are used in conjunction with a machine such as that which is shown and described by Eickenhorst in U.S. Pat. No. 3,635,069, the operation is as follows. In FIG. 3, the knockout punch 18 is shown in a position for receiving an open end 70 of the container 60.

Figure 4:
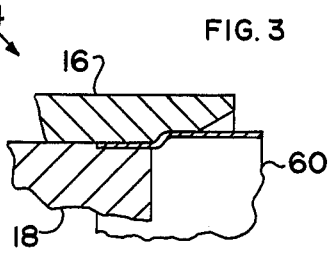
FIG. 4 is a partial cross-section of the necking die set and container of FIG. 3, taken substantially as shown in FIG. 3, but showing both the knockout punch and the container as positioned at the completion of the necking operation.

In FIG. 4, the container 60 has been forced into the necking die 16 by force from a ram (not shown) and a punch (not shown) putting pressure onto a domed bottom 72 (FIG. 1) of the container 60; and the knockout punch 18 has moved leftwardly, moving a shoulder 74 (FIG. 3) thereof leftwardly to allow penetration of the open end 70 (FIG. 3) of the necking die 16 to the position as shown in FIG. 4.

Figure 5:
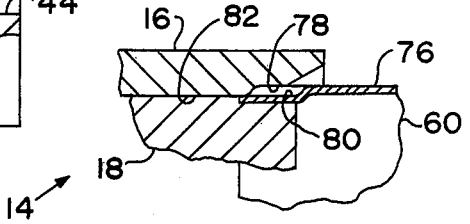
FIG. 5 is a partial cross-section of the necking die set and container of FIG. 4, taken substantially as shown in FIG. 4, but showing the knockout punch position wherein the container is released from the necking die, and showing the beverage container still retained on the knockout punch, but ready for pneumatic stripping.

In FIG. 5, the knockout punch 18 has moved rightwardly pushing the container 60 to the position shown by engagement of the shoulder 74 (FIG. 3) with the open end 70 (FIG. 3) of the container 60, thereby freeing the unnecked portion 76 of the container 60 from an enlarged bore 78 of the necking die 16 and also freeing a reduced diameter or necked portion 80 of the container 60 from a cylindrical bore 82 of the necking die 16.

Figure 6:
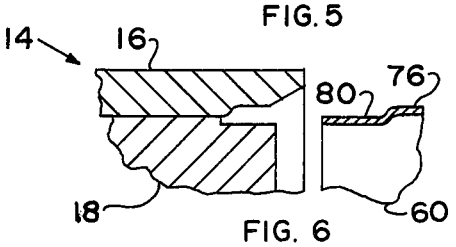
FIG. 6 is a partial cross-section of the necking die set and container of FIG. 5, taken substantially as shown in FIG. 5, but subsequent to pneumatic stripping of the container.

In this FIG. 5 position, which is the same as the FIG. 1 position, the knockout punch 18 is positioned for pneumatic stripping. At this time, compressed air is supplied to the hole 26 (FIG. 1), the velocity and pressure of the compressed air is reduced in the expansion chamber 48, and air at lower pressure and lower velocity is supplied to the bottomed recess 58 of the container 60 via the second passageway means which includes the holes 56. Application of compressed air to the interior or bottomed recess 58 of the container 60 results in stripping the container 60 from the knockout punch 18 as shown in FIG. 6.

Referring again to FIGS. 1 and 2, bores 78 and 82 are concentric to a second elongated longitudinal axis 84; and the longitudinal axes 22 and 84 are concentric. In addition, a necking support portion 86 of the knockout punch 18 is concentric with a full body diameter portion 88 of the knockout punch 18.

In a preferred configuration, the hole 52 is 3.2 millimeters in diameter, and the holes 56 are four in number and 2.4 millimeters in diameter. Thus the minimum flow path area of the first passageway means is limited by the diameter of the hole 52; and the minimum flow path area is 8.0 square millimeters. In like manner, in a preferred configuration, the longitudinally disposed holes 56 are six in number and 2.4 millimeters in diameter; so that the minimum flow path area of the second passageway means is 27.1 square millimeters. Thus the minimum flow path area of the second passageway means is 3.4 times as large as the minimum flow path area of the first passageway means.

The abovementioned dimensions reduce the Reynolds number of the air flow from approximately 38,000 to approximately 15,000 where compressed air is supplied to the first minimum flow path air above 40 psi, and where the Reynolds number is defined by:

$$N_R = VD\rho/\mu$$

where:

$N_R$ = Reynolds number, a dimensionless number

V = Velocity of the air through a minimum flow path area

D = Diameter of the same minimum flow path area $\rho$ = Density of air $\mu$ = Dynamic viscosity of the air However, at the present time, it is believed that calculated sound power levels are the best design criteria; and either the sound power in watts or decibels may be used to optimize the parameters of the present invention.

The sound power is calculated from the formula:

$$pW = M^5 \rho/2\ V^3 A$$

where suitable units and comparable conversion factors are used and where:

pW = Sound power in picowatts = Watts $\times 10^{-12}$

M = Mach number = air velocity in a minimum flow path area divided by the speed of sound of air $\rho$ = Fluid mass density of air V = Velocity of air in the same minimum flow path area A = Area of the same minimum flow path area The sound power level in decibels is calculated from the sound power in picowatts as follows:

$$dB = 10 \log_{10} (pW)$$

where:

dB = The sound power level in decibels $\log_{10}$ = The logarithm to the base 10 pW = Picowatts = watts $\times 10^{-12}$

Using the above formulas with the minimum flow path areas as defined above, the sound power level for discharging the hole 52 of the first passageway directly to the atmosphere, as was the prior art practice, produces a sound power level of 97.5 dB, whereas, the sound power level for the present invention calculates to be 65.5 dB.

According to the above calculations, the present invention may achieve sound power level reductions on the order of 32 dB; and actual tests have resulted in reducing sound power levels by about 20 dB. In addition, in the preferred embodiment, the expansion chamber 48 has a volume of 5.56 cubic centimeters and the second passageway means, including all six of the holes 56, has a volume of 0.75 cubic centimeters; so that the ratio of the volume of the expansion chamber 48 to the volume of the second passageway means is 7.41.

Appreciable noise reduction is believed to be attainable by designs wherein the minimum flow path area of second passageway means is at least twice as large as the minimum flow path area of the first passageway means, and wherein the volume of the expansion chamber 48 is at least twice as large as the volume of the second passageway means. However, it is presently believed that the previously mentioned dimensions provide optimum noise reduction for stripping containers 60 from the knockout punch 18 subsequent to the necking operation.

The mandrel means 46, in the broadest terms, comprises a shaft portion and a head portion with the recess 50 being formed therebetween. Further, it is contemplated that the knockout punch 18 could be formed in two pieces, one being the head portion and the other being the shaft portion. Whatever the terminology, and whatever the variation in embodiments, the expansion chamber 48 is formed by providing a recess 50 between juxtaposed and abutting ends, such as the ends 24 and 30.

It is further contemplated that the present invention can be used for pneumatic stripping of any article of manufacture of the type having a bottomed recess.

While there have been described above the principles of the present invention in connection with specific apparatus, it is to be clearly understood that the description is made only by way of example; and the scope of the invention is to be defined by the appended claims.

INDUSTRIAL APPLICABILITY

The present invention is industrially applicable to machines that handle articles of manufacture of the type having a bottomed recess, and it is more particularly applicable to metal forming machines, including neckers, that are used in the production of thin shell containers, such as beverage cans, wherein pneumatic stripping of the cans from a punch portion of the die set is advantageous.

What is claimed is:

1. In a machine of the type which includes mandrel means, comprising a shaft portion having both an elongated longitudinal axis and a first end that is substantially orthogonal to said longitudinal axis and comprising a head portion that is secured to said shaft portion with a second end of said head portion juxtaposed against said first end and a third end of said head portion distal from said juxtaposed ends, for insertion of said third end into a bottomed recess of an article of manufacture, and stripping means, comprising compressed air for stripping said article from said head portion, the improvement in which said stripping means comprises: an expansion chamber comprising a recess in one of said portions that extends longitudinally inward from the respective one of said juxtaposed ends; first passageway means, having a first minimum flow path area, for supplying said compressed air to said expansion chamber; and second passageway means, comprising a hole that communicates with said third end, and having a second minimum flow path area, for receiving compressed air from said expansion chamber, and for delivering said compressed air into said bottomed recess of said article, said second passageway means having a first volume and said expansion chamber having a second volume, said second volume being twice as large as said first volume.

2. In a necking machine of the type which includes necking die means, comprising a substantially cylindrical bore that is disposed about a first elongated longitudinal axis and comprising first and second ends, for receiving an open end of a container into said cylindrical bore through said first end and for reducing the diameter of said container proximal to said open end, ram portion means, being disposed generally longitudinally outward from said second end, having a second elongated longitudinal axis that is substantially coaxial with said first elongated axis, having a third end that is substantially orthogonal to said second longitudinal axis and that faces toward said container, for providing reciprocating motion along said second elongated longitudinal axis, said ram portion means including a first longitudinally disposed hole being substantially coaxial with said second elongated longitudinal axis, opening through said third end, and having internal threads that open through said third end, knockout portion means, having a fourth end that is juxtaposed against said third end, being secured to said ram portion means, said knockout portion means having a fifth end that is distal from said ram portion means and that is reduced in diameter, and having a shoulder intermediate of said reduced diameter and said fourth end, for insertion into said cylindrical bore and for reciprocating therein, for insertion of said fifth end into said reduced open end, for abutting said open end with said shoulder, and for forcing said container from engagement with said cylindrical bore, and stripping means, comprising compressed air, for stripping said container from said insertion of said fifth end, the improvement in which said stripping means comprises: an expansion chamber comprising a recess in one of said portions that extends longitudinally inward from the respective one of said juxtaposed ends, said knockout portion means being secured to said ram portion means by a threaded fastener having an externally threaded end, being screwed into said internal threads, having a second longitudinally disposed hole that opens through said externally threaded end, and having a transverse hole that communicates with both said second longitudinally disposed hole and said expansion chamber, first passageway means, having a first minimum flow path area, for supplying said compressed air to said expansion chamber, said first passageway means comprising said first longitudinally disposed hole, said second longitudinally disposed hole, and said transverse hole, and second passageway means, comprising a hole that communicates with said fifth end, and having a second minimum flow path area, for receiving compressed air from said expansion chamber, and for delivering said compressed air into said container, said second passageway means having a first volume, said expansion chamber having a second volume, and said second volume being twice as large as said first volume.

3. In a machine of the type which includes mandrel means, comprising a shaft portion having both an elongated longitudinal axis and a first end that is substantially orthogonal to said longitudinal axis and comprising a head portion that is secured to said shaft portion with a second end of said head portion juxtaposed against said first end and a third end of said head portion distal from said juxtaposed ends, for insertion of said third end into a bottomed recess of an article of manufacture, and stripping means, comprising compressed air for stripping said article from said head portion, the improvement in which said stripping means comprises: an expansion chamber comprising a recess in one of said portions that extends longitudinally inward from the respective one of said juxtaposed ends; first passageway means, having a first minimum flow path area, for supplying said compressed air to said expansion chamber; second passageway means, comprising a hole that communicates with said third end, and having a second minimum flow path area, for receiving compressed air from said expansion chamber, and for delivering said compressed air into said bottomed recess of said article, and diffusion means, comprising a porous diffusing material that is disposed in said expansion chamber, for diffusing said compressed air entering said expansion chamber.

4. In a necking machine of the type which includes necking die means, comprising a substantially cylindrical bore that is disposed about a first elongated longitudinal axis and comprising first and second ends, for receiving an open end of a container into said cylindrical bore through said first end and for reducing the diameter of said container proximal to said open end, ram portion means, being disposed generally longitudinally outward from said second end, having a second elongated longitudinal axis that is substantially coaxial with said first elongated axis, having a third end that is substantially orthogonal to said second longitudinal axis and that faces toward said container, for providing reciprocating motion along said second elongated longitudinal axis, said ram portion means including a first longitudinally disposed hole being substantially coaxial with said second elongated longitudinal axis, opening through said third end, and having internal threads that open through said third end, knockout portion means, having a fourth end that is juxtaposed against said third end, being secured to said ram portion means, said knockout portion means having a fifth end that is distal from said ram portion means and that is reduced in diameter, and having a shoulder intermediate of said reduced diameter and said fourth end, for insertion into said cylindrical bore and for reciprocating therein, for insertion of said fifth end into said reduced open end, for abutting said open end with said shoulder, and for forcing said container from engagement with said cylindrical bore, and stripping means, comprising compressed air, for stripping said container from said insertion of said fifth end, the improvement in which said stripping means comprises: an expansion chamber comprising a recess in one of said portions that extends longitudinally inward from the respective one of said juxtaposed ends, said knockout portion means being secured to said ram portion means by a threaded fastener having an externally threaded end, being screwed into said internal threads, having a second longitudinally disposed hole that opens through said externally threaded end, and having a transverse hole that communicates with both said second longitudinally disposed hole and said expansion chamber, first passageway means, having a first minimum flow path area, for supplying said compressed air to said expansion chamber, said first passageway means comprising said first longitudinally disposed hole, said second longitudinally disposed hole, and said transverse hole, second passageway means, comprising a hole that communicates with said fifth end, and having a second minimum flow path area, for receiving compressed air from said expansion chamber, and for delivering said compressed air into said chamber, and diffusion means, comprising a porous diffusing material that is disposed in said expansion chamber, for diffusing said compressed air entering said expansion chamber.

5. In a machine of the type which includes mandrel means, comprising a shaft portion having both an elongated longitudinal axis and a first end that is substantially orthogonal to said longitudinal axis and comprising a head portion that is secured to said shaft portion with second end of said head portion juxtaposed against said first end and a third end of said head portion distal from said juxtaposed ends, for insertion of said third end into a bottomed recess of an article of manufacture, and stripping means, comprising compressed air for stripping said article from said head portion, the improvement in which said stripping means comprise: an expansion chamber comprising a recess in one of said portions that extends longitudinally inward from the respective one of said juxtaposed ends, first passageway means, having a first minimum flow path area, for supplying said compressed air to said expansion chamber, and second passageway means, comprising a hole that communicates with said third end, and having a second minimum flow path area, for receiving compressed air from said expansion chamber, and for delivering said compressed air into said bottomed recess of said article, the velocity of compressed air flowing through said second minimum flow path area being lower than the velocity of compressed air flow through said second flow path area by a factor that reduces the calculated sound power level by at least 10 dB as compared to the calculated sound power level through said first minimum flow path area.

6. In a machine of the type which includes mandrel means, comprising a shaft portion having both an elongated longitudinal axis and a first end that is substantially orthogonal to said longitudinal axis and comprising a head portion that is secured to said shaft portion with a second end of said head portion juxtaposed against said first end and a third end of said head portion distal from said juxtaposed ends, for insertion of said third end into a bottomed recess of an article of manufacture, said shaft portion including a first longitudinally disposed hole being substantially coaxial with said longitudinal axis, opening through said first end, and having internal threads that open through said first end, and stripping means, comprising compressed air for stripping said article from said head portion, the improvement in which said stripping means comprises: an expansion chamber comprising a recess in one of said portions that extends longitudinally inward from the respective one of said juxtaposed ends, first passageway means, having a first minimum flow path area, for supplying said compressed air to said expansion chamber, said first passageway means comprising said first longitudinally disposed hole, said second longitudinally disposed hole, and said transversed hole, said securing of said head portion to said shaft portion comprising a threaded fastener having an externally threaded end, being screwed into said internal threads, having a second longitudinally disposed hole that opens through said externally threaded end, and having a transverse hole that communicates with both said second longitudinally disposed hole and said expansion chamber, and second passageway means, comprising a hole that communicates with said third end, and having a second minimum flow path area, for receiving compressed air from said expansion chamber, and for delivering said compressed air into said bottomed recess of said article, the velocity of compressed air flowing through said second minimum flow path area being lower than the velocity of compressed air flow through said second flow path area by a factor that reduces the calculated sound power level by at least 10 dB as compared to the calculated sound power level through said first minimum flow path area.

7. In a necking machine of the type which includes necking die means, comprising a substantially cylindrical bore that is disposed about a first elongated longitudinal axis and comprising first and second ends, for receiving an open end of a container into said cylindrical bore through said first end and for reducing the diameter of said container proximal to said open end, ram portion means, being disposed generally longitudinally outward from said second end, having a second elongated longitudinal axis that is substantially coaxial with said first elongated axis, having a third end that is substantially orthogonal to said second longitudinal axis and that faces toward said container, for providing reciprocating motion along said second elongated longitudinal axis, knockout portion means, having a fourth end that is juxtaposed against said third end, being secured to said ram portion means, having a fifth end that is distal from said ram portion means and that is reduced in diameter, and having a shoulder intermediate of said reduced diameter and said fourth end, for insertion into said cylindrical bore and for reciprocating therein, for insertion of said fifth end into said reduced open end, for abutting said open end with said shoulder, and for forcing said container from engagement with said cylindrical bore, and stripping means, comprising compressed air, for stripping said container from said insertion of said fifth end, the improvement in which said stripping means comprises: an expansion chamber comprising a recess in one of said portions that extends longitudinally inward from the respective one of said juxtaposed ends, first passageway means, having a first minimum flow path area, for supplying said compressed air to said expansion chamber, and second passageway means, comprising a hole that communicates with said fifth end, and having a second minimum flow path area, for receiving compressed air from said expansion chamber, and for delivering said compressed air into said container, the velocity of compressed air flowing through said second minimum flow path area being lower than the velocity of compressed air flow through said second flow path area by a factor that reduces the calculated sound power level by at least 10 dB as compared to the calculated sound powder level through said first minimum flow path area.

8. In a necking machine of the type which induces necking die means, comprising a substantially cylindrical bore that is disposed about a first elongated longitudinal axis and comprising first and second ends, for receiving an open end of a container into said cylindrical bore through said first end and for reducing the diameter of said container proximal to said open end, ram portion means, being disposed generally longitudinally outward from said second end, having a second elongated longitudinal axis that is substantially coaxial with said first elongated axis, having a third end that is substantially orthogonal to said second longitudinal axis and that faces toward said container, for providing reciprocating motion along said second elongated longitudinal axis, said ram portion means including a first longitudinally disposed hole being substantially coaxial with said second elongated longitudinal axis, opening through said third end, and having internal threads that open through said third end, knockout portion means, having a fourth end that is juxtaposed against said third end, being secured to said ram portion means, said knockout portion means having a fifth end that is distal from said ram portion means and that is reduced in diameter, and having a shoulder intermediate of said reduced diameter and said fourth end, for insertion into said cylindrical bore and for reciprocating therein, for insertion of said fifth end into said reduced open end, for abutting said open end with said shoulder, and for forcing said container from engagement with said cylindrical bore, and stripping means, comprising compressed air, for stripping said container from said insertion of said fifth end, the improvement in which said stripping means comprises: an expansion chamber comprising a recess in one of said portions that extends longitudinally inward from the respective one of said juxtaposed ends, said knockout portion means being secured to said ram portion means by a threaded fastener having a externally threaded end, being screwed into said internal threads, having a second longitudinally disposed hole that opens through said externally threaded end, and having a transverse hole that communicates with both said second longitudinally disposed hole and said expansion chamber, first passageway means, having a first minimum flow path area, for supplying said compressed air to said expansion chamber, said first passageway means comprising said first longitudinally disposed hole, said second longitudinally disposed hole, and said transverse hole, and second passageway means, comprising a hole that communicates with said fifth end, and having a second minimum flow path area, for receiving compressed air from said expansion chamber, and for delivering said compressed air into said container, the velocity of compressed air flowing through said second minimum flow path area being lower than the velocity of compressed air flow through said second flow path area by a factor that reduces the calculated sound power level by at least 10 dB as compared to the calculated sound power level through said first minimum flow path area.

* * * * *